United States Patent [19]

Minegishi et al.

[11] Patent Number: 4,725,711

[45] Date of Patent: Feb. 16, 1988

[54] SELF TEMPERATURE CONTROL TYPE GLOW PLUG

[75] Inventors: Sokichi Minegishi, Higashimatsuyama; Koji Hatanaka, Hiki; Seiichi Kojima, Honjo, all of Japan

[73] Assignee: Jidosha Kiki Co., Ltd., Tokyo, Japan

[21] Appl. No.: 764,631

[22] Filed: Aug. 12, 1985

[30] Foreign Application Priority Data

Aug. 27, 1984 [JP] Japan ..... 59-176722
Dec. 28, 1984 [JP] Japan ..... 59-197811

[51] Int. Cl.[4] ..... F23Q 7/22; F02P 9/08; H05B 3/02

[52] U.S. Cl. ..... 219/270; 123/145 A; 219/505; 219/539; 219/544; 219/553; 338/22 R; 338/238; 361/266

[58] Field of Search ..... 219/260, 267, 270, 544, 219/552, 553, 534, 539, 505; 338/238–242, 22 R; 123/145, 145 A; 361/264–266

[56] References Cited

U.S. PATENT DOCUMENTS

| | | | |
|---|---|---|---|
| 2,030,937 | 2/1936 | Reichman | 123/145 A |
| 2,492,755 | 12/1949 | McCollum | 219/270 X |
| 4,107,510 | 8/1978 | Tombs et al. | 123/145 A X |
| 4,359,977 | 11/1982 | Sperner et al. | 123/145 A |
| 4,502,430 | 3/1985 | Yokoi et al. | 219/270 X |
| 4,545,339 | 10/1985 | Brooks et al. | 123/145 A |

FOREIGN PATENT DOCUMENTS

| | | | |
|---|---|---|---|
| 45-11648 | 4/1970 | Japan . | |
| 54-109538 | 8/1979 | Japan . | |
| 57-41523 | 3/1982 | Japan . | |
| 110919 | 7/1983 | Japan | 219/270 |
| 157424 | 9/1984 | Japan | 219/270 |
| 231321 | 12/1984 | Japan | 219/270 |
| 2144175 | 2/1985 | United Kingdom | 219/270 |

*Primary Examiner*—Anthony Bartis
*Attorney, Agent, or Firm*—Claude A. S. Hamrick

[57] ABSTRACT

A self-regulating temperature controlled glow plug has a hollow metal holder, a rod-like ceramic heater and a power control heater. The ceramic heater extends from one end of the holder and has embedded therein a first resistor of tungsten alloyed with rhenium or molybdenum. The power control heater includes a second resistor embedded in a dense mass of powdered insulation material filling a tubular metallic sheath. The sheath is positioned in the holder with its central portion held in spaced relationship thereto by a thermally insulating spacer at least one end thereof. The second resistor is made of tungsten, iron or nickel, has a positive temperature coefficient of resistance at least equal to and a heating capacity greater than the first resistor, and is connected in series with the first resistor.

4 Claims, 9 Drawing Figures

SELF TEMPERATURE CONTROL TYPE GLOW PLUG

BACKGROUND OF THE INVENTION

The present invention relates to a self temperature control type glow plug.

Since a diesel engine generally starts poorly at a low temperature, a glow plug is mounted in a subcombustion or combustion chamber. A current flows in the glow plug which is then heated to increase an intake air temperature or improve the starting characteristics of the diesel engine. A so-called sheath type glow plug is mainly used as the glow plug of this type. In the sheath type glow plug, a heat-resistant insulating powder such as a magnesia powder is filled in the sheath of a heat-resistant metal. Thus, such a conventional glow plug can withstand the severe conditions such as a high temperature gas in the subcombustion or combustion chamber.

However, the conventional sheath glow plug has poor heat combustion efficiency since heat is indirectly transferred through the heat-resistant insulating powder and the sheath. It takes a long period of time to heat the glow plug, and the conventional glow plug cannot serve as a fast heat type plug. Several tens of seconds are required to heat the glow plug to a temperature of 900° C., and the diesel engine cannot be immediately started. In the sheath type glow plug, the sheath is exposed to severe conditions such as a high temperature in the engine combustion chamber, and at the same time, the temperature difference between the interior and exterior of the engine combustion chamber is large. An overload is imposed on the internal heating wire which becomes damaged and often disconnected, resulting in inconvenience.

In order to resolve this problem, another conventional glow plug is proposed in Japanese Patent Prepublication No. 57-41523. According to this glow plug, a rod-like ceramic heater is used in place of the above-mentioned sheath, the rod-like ceramic heater being obtained by embedding a heating wire of tungsten (W) or the like in a ceramic material. This conventional glow plug has better heating characteristics than the conventional sheath type glow plug. The glow plug can be heated in a short period of time, and good temperature rise characteristics can be obtained. As a result, this type of glow plug can serve as a fast heating type plug.

However, in such a glow plug with a ceramic heater, only one type of heating wire is embedded therein in the same manner as in the conventional sheath type glow plug. An energization time of the conventional glow plug with a ceramic heater cannot be easily controlled. In the glow plug of this type, in order to greatly improve the temperature rise characteristic, a large current is flowed during the initial period of the energization time to rapidly heat the heating wire. However, the heating wire is apt to melt and become disconnected, and the ceramic heater tends to be adversely affected due to a high temperature. This high temperature also adversely affects a battery and an electrical circuit, and a fuse may be blown. In order to prevent this, a temperature control means must be added to the heating wire circuit. As a result, the preheating apparatus including the glow plug results in high cost.

In so-called bi-material self temperature control type glow plugs proposed in Japanese Patent Publication No. 45-11648 and Japanese Patent Prepublication No. 54-109538, energization power supplied to the heating wire is self-controlled to prevent overheating of the heater and to improve the heating characteristics. For this purpose, a resistor made of a material having a larger resistance temperature coefficient (PTC) than that of the installed heating wire (i.e., the heater) is used as an energization power control element and is connected in series with the heating wire within the glow plug.

These conventional glow plugs, however, fail to satisfy control function reliability and fast heating.

In the former conventional glow plug, since the power control resistor mounted in the holder must be stably held with the resistor insulated from the holder, an insulating material such as water glass is filled in the inner wall surface of the holder. The holder structure and the manufacturing process are complex. In addition, it is impossible to fill the insulating material with a high filling density in practice. Variations in heat radiation from the resistor are large, and the thermal capacity of the resistor cannot be stabilized. As a result, energization power control for the heating wire cannot be stabilized.

In the latter conventional glow plug, since the heating wire is connected in series with the resistor in the sheath, a filling density of the insulating material around the resistor is set high to effectively improve the heating characteristics. However, forming the electrical connection between the heating wire and the resistor is time-consuming and troublesome, resulting in inefficient assembly. It is impossible to completely prevent heat conducted to the resistor from having an influence upon energization of the heating wire. With this arrangement, the high filling density of the insulating material around the resistor can be achieved and fast heating can be accomplished to some extent. However, the heating time cannot be shortened to less than 10 seconds, and the saturation temperatures cannot be kept below a predetermined value (e.g., 1,000° C. or less). As a result, the energization time after starting of the engine (i.e., an after glow time) cannot be prolonged, resulting in inconvenience.

Demand has recently arisen for employing a so-called "after glow" system, i.e., a system for maintaining energization of the glow plug for a predetermined period of time aftere engine start so as to perform smooth and proper combustion in the engine. The after glow time must be increased as much as possible. Even after starting, if the engine is excessively cold and in a cold area, it takes a long period of time to warm the engine. In a cold state, idling noise is large, white smoke is produced by incomplete combustion, and exhaust gases due to engine stopping as well as engine noise result.

Diesel engines are classified into direct injection and subcombustion chamber type engines. The direct injection type engine requires only an after glow time of less than about 30 seconds and performance and durability of the conventional glow plug structure are not adversely affected. Only small problems occur with this type of engine when the conventional glow plug is installed.

However, in the subcombustion chamber type engine, an after glow time of about 30 seconds is not sufficient. An engine of this type sometimes requires an after glow time of 3 minutes or more. In this case, durability of the respective parts of the glow plug may be adversely affected. A voltage of about 11 V is applied to the conventional glow plug during preheating (about 5 seconds). When the engine is started, the setting voltage of the regulator is increased to as high as about 14 V and this voltage is applied to the glow plug. When the after glow time is increased, the temperature of the glow plug is excessively increased due to the high voltage and the heater and the resistor in the glow plug may be damaged or melted and disconnected.

In particular, since diesel engines have recently been mounted in general vehicles, demand has arisen for production of a fast heating type glow plug to immediately start these engines in the same manner as gasoline engines. At the same time, demand has also arisen for increased after glow time so as to reduce exhaust gases and noise. These demands are contradictory in a technical sense. In order to achieve fast heating described above, high power must be supplied to the heating wire at the beginning of the energization time. However, in order to increase the after glow time, a large current cannot be supplied to the heating wire. Therefore, a glow plug of simple structure satisfying these contradictory demands within an allowable range has been desired.

SUMMARY OF THE INVENTION

It is, therefore, an object of the present invention to provide a fast heating type self temperature control type glow plug wherein a heating member is improved to achieve an extended after glow time.

In order to achieve the above object of the present invention, there is provided a low-cost self temperature control type glow plug, wherein a first resistor serving as a heater in a ceramic heater held at a distal end of a hollow holder is connected in series with a power control second resistor having a larger resistance temperature coefficient than that of the first resistor, and the second resistor is held in the hollow holder through an insulating thermal conductor. With this simple arrangement, the power control function of the second resistor can be effectively utilized to provide proper heating at the distal end of the ceramic heater at a high speed, thereby improving the capacity for fast heating and hence greatly improving starting performance of the engine. At the same time, the after glow time can be prolonged to decrease the exhaust gas and noise which are produced by the engine. The self temperature control type glow plug has a simple structure and can be easily assembled.

DESCRIPTION OF THE PREFERRED EMBODIMENT

The present invention will be described in detail with reference to a preferred embodiment in conjunction with the accompanying drawings.

Figure 1:
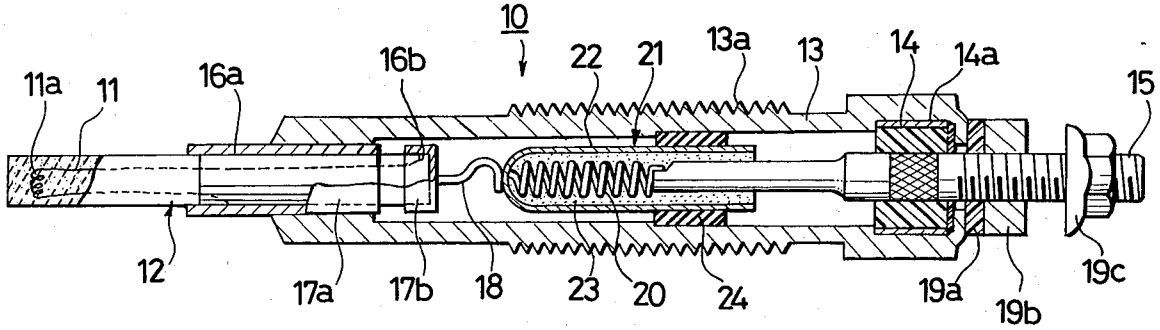
FIG. 1 is a sectional view showing a self temperature control type glow plug according to an embodiment of the present invention.

FIG. 1 is a self temperature control type glow plug according to an embodiment of the present invention. A glow plug 10 comprises a rod-like ceramic heater 12 and a metal holder 13. The ceramic heater 12 is made of a heat-resistant electrically insulating ceramic material in which a first resistor 11 serving as a heater is embedded. The metal holder 13 has a tubular shape and holds the ceramic heater 12 at its distal end. An external connecting terminal 15 is concentrically mounted in the rear portion of the holder 13 through an insulating bushing 14. The external connecting terminal 15 is connected to the first resistor 11 through a sheath heater 21 and a metal wire 18. The sheath heater 21 has a second resistor 20 having a power control function (to be described later). The metal wire 18 is a flexible wire extending from the rear end of the ceramic heater 12.

The ceramic heater 12 has a substantially elliptical cross-section consisting of elliptical curves and straight sides constituting the opposing sides. The ceramic heater 12 is formed by compressing and sintering a ceramic powder filled in molds while the first resistor 11 is held in the molds. The substantially elliptical cross-section provides a higher density of the ceramic material than that of a circular cross-section, thereby improving its heat resistance and thermal conductivity. The material of the ceramic heater 12 preferably comprises so-called fine ceramic (i.e., a silicon monoxide) such as silicon nitride which is stable at high temperatures (up to about 1,700° C.) has good insulation and high thermal impact strength properties. In particular, silicon nitride has a better high-temperature strength than that of a metal material or alumina. The thermal impact strength, high-temperature electrical insulation, anti-wear and anti-chemical properties of silicon nitride are far better than those of a metal material or alumina. Therefore, silicon nitride substantially satisfies the specifications required for the glow plug of this type.

Reference numerals **17*a* and 17*b* denote a metal pipe and a terminal cap which are brazed with silver at the central portion (along the longitudinal direction of the ceramic heater 12) and at the rear end portion of the ceramic heater 12, respectively. Two ends of the lead wire of the first resistor 11 embedded in the creamic heater 12 are electrically connected to the pipe and the cap via metal coating layers 16*a* and 16*b* directly or through lead wires, respectively. The first resistor 11 in the heater is connected at one end to the holder 13 through the pipe 17*a* for holding the central portion of the ceramic heater 12. At the same time, the first resistor 11 is connected at its other end to the external connecting terminal 15 through the control sheath heater 21 by the conductor 18 extending backward through the terminal cap 17*b***.

An insulating ring **19*a*, a fastening nut 19*b* and an external lead tighting nut 19*c* are threadably engaged with a threaded portion formed at the rear end portion of the external connecting terminal 15. A lead wire from a battery (not shown) is clamped between the nuts 19*b*** and 19c, and the nut 19c is tightened, so that the external connecting terminal 15 is electrically connected to the battery terminal. A threaded portion 13a formed on the outer surface of the holder 13 is engaged in a screw hole formed in a cylinder head of the engine. The other end of the ceramic heater 12 which is located at the heating side is grounded through the holder 13. At the same time, the distal end of the ceramic heater 12 extends inside the subcombustion or combustion chamber.

A metal pipe 14a is fitted at the rear end portion of the holder 13 on the outer surface of the insulating bushing 14 for holding the external connection terminal 15. The metal pipe 14a is caulked during assembly and is buckled along the axial direction under a high pressure. The insulating bushing 14 is thus formed integrally with the holder 13 with a predetermined mechanical strength to provide a heat free structure. If only a conventional plastic insulating bushing 14 were used, it would expand or contact in accordance with changes in ambient temperature, resulting in looseness between the bushing 14 and the holder 13. However, by using the metal pipe 14a, the mechanical strength between the insulating bushing 14 and the holder 13 is improved. The insulating bushing 14 is formed integrally with the external connecting terminal 15 to guarantee the torsion strength.

Figure 3:
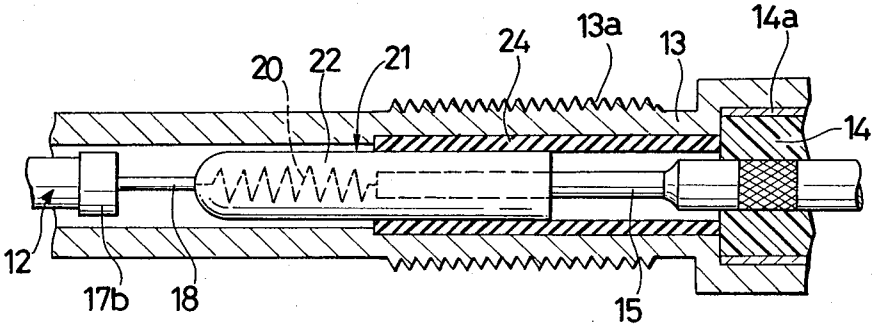
FIG. 3 is a sectional view showing a modification of the glow plug of FIG. 1.

In the above construction, the sheath heater 21 connected to the external terminal 15 is connected to the ceramic heater 12 through the metal conductor 18 consisting of a flexible wire. This is to mechanically protect a ceramic heater 12 from outer forces such as various vibrations and a fastening torque which acts on the external connecting terminal 15. The material of the conductor 18 must be flexible to some extent. In this case, when the conductor 18 is curved, the protection effect can be further improved. However, as shown in FIG. 3, the conductor 18 can be straight.

According to the ceramic heater 12 having the structure described above, since the first resistor 11 serving as the heater is directly embedded in the ceramic material, fast heating can be achieved as compared with the conventional sheath type glow plug. The distal end of the ceramic heater 12 can be immediately heated to greatly improve the engine starting performance, and thus engine output can be optimal and smooth.

The first resistor 11 embedded in the ceramic heater 12 comprises a high-melting metal such as Pt (platinum) or W (tungsten) in consideration of the sintering temperature of the ceramic material during hot pressing.

In the glow plug 10 having the construction described above according to this embodiment, as shown in FIG. 1, one end of the first resistor 11 of the ceramic heater 12 held at the distal end of the holder 13 is electrically connected in series with the sheath heater 21 having the second resistor 20 through the conductor 18. The sheath heater 21 is arranged with a heat-resistant insulating powder 23 filled in metal sheath 22 while the second resistor 20 is sealed therein. The sheath 22 is fitted in a heat-resistant insulating tube 24, and the resultant assembly is fitted in the holder 13.

According to this embodiment, the ceramic heater 12 having good fast heating and heat-resistance properties is used together with the sheath heater 21 as an energization power controlling means which has the same structure as in the conventional glow plug and controls energization of the ceramic heater 12. The assembly of the ceramic heater 12 and the sheath heater 21 is fitted in the holder 13. As a result, fast heating and a low saturation temperature which are required for the glow plug 10 are achieved. In the case of the sheath heater 21, the second resistor 20 can be sealed in the sheath 22 with the heat-resistant insulating powder 23. Unlike in the conventional glow plug, a heat radiation problem can be resolved, heat conduction from the second resistor 20 to the external atmosphere is stable, and thus the performance of the ceramic heater 12 is stabilized. The heat capacity of the sheath heater 21 is designed to be larger than that of the ceramic heater 12. Therefore, the control function of the heat radiation characteristics of the second resistor 20 can be properly obtained.

More particularly, the heat-resistant insulating powder 23 such as magnesia (MgO) or zirconia ($ZrO_2$) is filled in the sheath 22 while the second resistor 20 is held therein. The diameter of one end of the sheath 22 is decreased so as to achieve a high density of the heat-resistant insulating powder 23. In other words, swaging of the sheath 22 is performed. Unlike in the conventional technique wherein a heat-resistant insulating powder is simply filled in the holder, the packing density of the powder in the sheath heater 21 can be greatly improved.

The heat capacity of the power control sheath heater 21 must be set to be larger than that of the ceramic heater 12 to increase the temperature of the second resistor 20 so as to properly increase the temperature of the ceramic heater. In order to optimally control the peak temperature and the saturation temperature of the ceramic heater 12 in accordance with the power control function, a temperature rise to some extent is required. The glow plug of this embodiment satisfies the two contradictory requirements.

With the second resistor 20 embedded in the heat-resistant insulating powder 23 filled in the sheath 22, a high voltage is applied to the first resistor 11 at the initial period of energization of the glow plug 10 in accordance with a ratio of the resistance of the first resistor 11 to that of the second resistor 20, thereby achieving fast heating. When a predetermined period of time has elapsed, the voltage applied to the first resistor 11 is decreased by the resistance of the second resistor 20 which is increased by heating.

In the sheath heater 21 using the sheath 22 whose rear end is open in the same manner as in the conventional sheath type glow plug, the second resistor 20 can be formed integrally with the external connection terminal 15, thereby simplifying the assembly thereof and improving accuracy. The sheath electrode 21 with the heat-resistant insulating tube 24 is inserted in the holder 13 and can be spot-welded to the metal wire 18 of the ceramic heater 12. In this manner, the assembly operation can be simplified The second resistor 20 comprises a material such as tungsten (W), nickel (Ni) or iron (Fe) having a positive resistance temperature coefficient (PTC) which is equal to or larger than that of the first resistor 11 of the heater 12. In the glow plug 10 having the arrangement described above, it was experimentally confirmed that the ratio of the resistance of the first resistor 11 to that of the second resistor 20 was 4:1 at the initial period of energization. According to this embodiment, since the temperature of the sheath heater 21 is low, the material of the second resistor 20 embedded therein can be selected from various materials.

The heat-resistant insulating tube 24 is made of a heat-resistance insulating material such as glass, ceramic or asbestos. According to this embodiment, the heat-resistant insulating tube 24 is fitted on the outer surface of the sheath heater 21 only at the end portion along the axial direction thereof, so that the sheath heater 21 is held in the holder 13 and thermally and electrically insulated therefrom. The heat-resistant insulating tube 24 is preferably mounted so as to avoid the heating portion of the sheath 22. With this arrangement, the sheath heater 21 is loosely held in the holder 13, and an air gap is formed between the sheath heater 21 and the holder 13, so that the heat radiation effect from the heater 21 to the holder 13 is properly limited. Therefore, the sheath heater 21 has a large heat capacity so as to optimally control the temperature of the ceramic heater 12. In addition, the air gap guarantees the electrical insulation of the ceramic heater 12. As shown in FIG. 3, the heat-resistant insulating tube 24 may extend to the rear end portion of the sheath heater 21 except for the heating portion.

In the glow plug 10 having the construction described above, when a voltage is applied to the sheath heater 21 through the external connection terminal 15 and to the ceramic heater 12 through the metal wire 18, the voltage is divided at the resistance ratio of the resistor 11 in the heater 12 to the resistor 20 in the heater 21, so that a high voltage is applied to the ceramic heater 12 since it has a smaller heat capacity than that of the sheath heater 21. In this manner, the sheath heater 21 receives higher power than that of the ceramic heater 12. As a result, the distal end of the ceramic heater 12 is heated. In this case, the ceramic heater 12 has a better fast heating function as compared with that of the conventional sheath type glow plug.

The sheath heater 21 is gradually heated when a predetermined period of time has elapsed after the initial period of energization. The resistance of the sheath heater 21 is increased accordingly. The divided voltages applied to the heaters 12 and 21 are gradually changed. A temperature of the ceramic heater 12 reaches its peak of about 1,100° to 1,250° C. and is then saturated at a temperature of about 1,000° C., thereby preventing overheating of the ceramic heater 12. In this state, the resistance of the second resistor 20 in the sheath heater 21 approximates that of the first resistor 11 of the ceramic heater 12. Since the voltage applied to the first resistor 11 is limited below a predetermined value in accordance with the control function of the second resistor 20, durability of the glow plug can be guaranteed even when the after glow time is prolonged.

According to the glow plug 10 with the construction described above, fast heating and long after glow time can be achieved by the ceramic heater voltage control function of the sheath heater 21 simply incorporated as a unit in the holder 13 without arranging a separate complicated control circuit, thus providing a great industrial advantage. In particular, with the arrangement described above, a period of heating the ceramic heater to a temperature of 900° C. can be within about 4 seconds. At the same time, the saturation and peak temperatures of the ceramic heater can be less than 1,000° C. and 1,250° C., respectively. Furthermore, an after glow time of 3 minutes or more can be guaranteed. These facts are apparent from the characteristics curves d and b of the first and second resistors 11 and 20 in FIG. 2. Note that the characteristic curve c represents the temperature characteristics when only the ceramic heater 12 is used. Curve "a" represents the temperature characteristic when both heater 12 and heater 21 are used.

In the glow plug 10 described above, when the first resistor 11 embedded in the ceramic heater 12 and used as the heater is made of an alloy material of a high-melting metal such as tungsten (W) having a resistance ratio of 4.5 or less from room temperature (20° C.) to a high temperature (1,000° C.), the following effect can be obtained.

In a conventional glow plug, a resistor of a high-melting point metal such as tungsten (W) is embedded in the ceramic heater 12 in consideration of the sintering temperature of the ceramic material during hot pressing. However, the present inventors made extensive studies based on the considerably higher resistance temperature coefficient of the above-mentioned material and found an alloy material which contains tungsten (W) as a major constituent and one or both of rhenium (Re) and molybdenum (Mo) and which has a markedly smaller resistance temperature coefficient than that of nickel (Ni) or iron (Fe) used for the second resistor 20. The present inventors also found that such an alloy was not limited by the above-mentioned sintering temperature since its melting point was about 2,400° C. or higher.

According to an experiment, about 3 to 26% of rhenium (Re) or about 5 to 50% of molybdenum (Mo) were preferable with respect to tungsten (W) as the major constituent. A mixture of rhenium and molybdenum may be mixed in tungsten. The ratio of resistance at a temperature of the alloy material containing tungsten, rhenium and molybdenum at 20° C. to that at a temperature of 1,000° C. is 4.5 or less.

Figure 2:
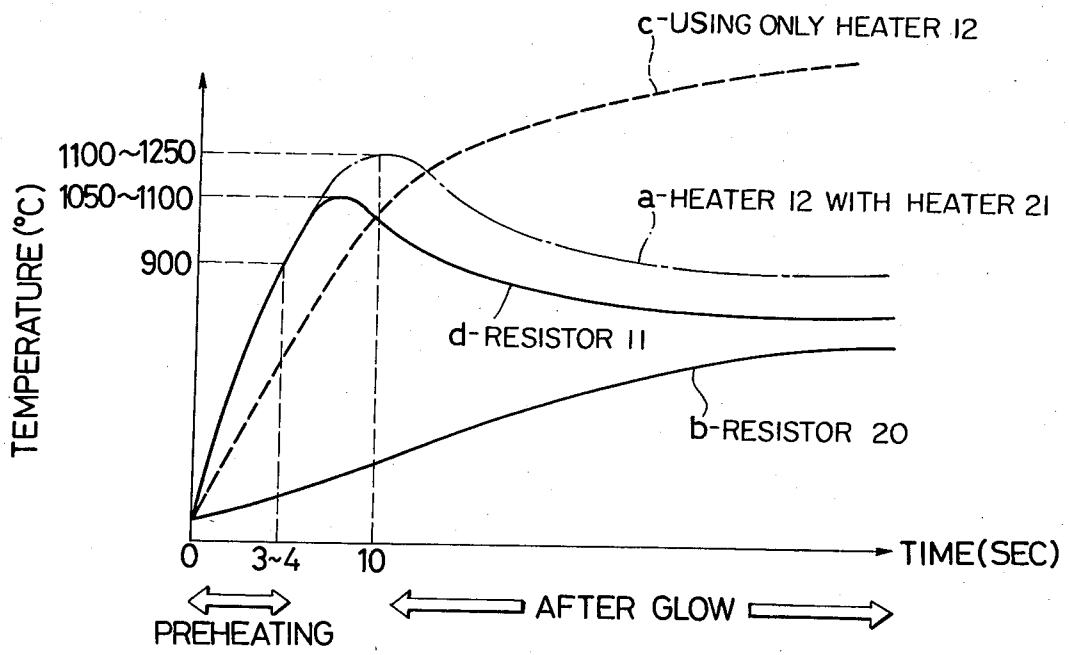
FIG. 2 is a graph showing the temperature characteristics of ceramic and sheath heaters as the main parts of the glow plug of FIG. 1.

The ceramic heater 12 described above was used together with a power control heater 21 (to be described later) to constitute the glow plug 10, and good characteristics were obtained as indicated by the characteristic curve d of FIG. 2.

With the above arrangement, the ceramic heater can be heated to a temperature of 900° C. within about 4 seconds, and its saturation and peak temperatures are set to be 1,000° C. or less and 1,100° C. or less, respectively. An after glow period of 3 minutes or more can be achieved. These facts are apparent from the characteristic curves d and b of the first and second resistors 11 and 20, as shown in FIG. 2.

Figure 4:
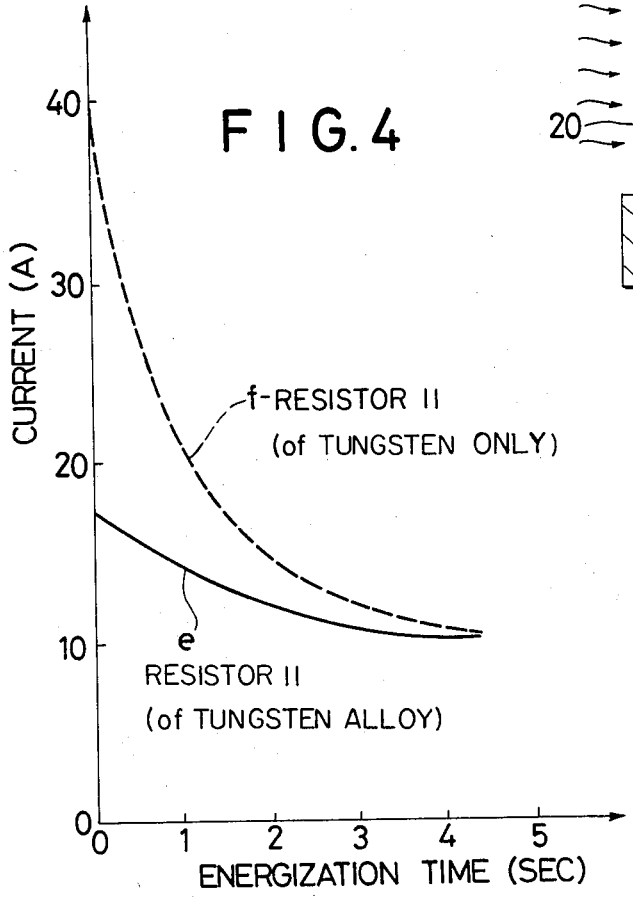
FIG. 4 is a graph showing current characteristics when a tungsten-based (containing rhenium) alloy and tungsten are used as materials of a first resistor.

FIG. 4 shows a current characteristic curve e when the first resistor 11 comprises as tungsten-based (containing rhenium) alloy material and a current characteristic curve f when the first resistor 11 comprises only tungsten. According to the first resistor 11 having the above characteristics, the peak and saturation temperatures of the first resistor 11 can be properly decreased in combination with the second resistor 20. At the same time, the current consumption can be decreased.

The material of the first resistor 11 embedded in the ceramic heater 12 need not be limited to a tungsten alloy. For example, a platinum alloy may be used in place of the tungsten alloy to obtain the same effect as described above. Platinum has a resistance ratio of 4.5 or less at room temperature compared to a high temperature. The platinum alloy can comprise platinum (Pt) as a major constituent and about 10 to 40% of rhodium (Rh), about 40 to 60% of iridium (Ir), a mixture of about 20 to 30% of rhodium and about 10% of palladium, about 5% of ruthenium, or about 5% of palladium.

The present invention is not limited to the particular embodiment described above. The shape and construction may be changed and modified within the scope and spirit of the present invention.

Figure 6:
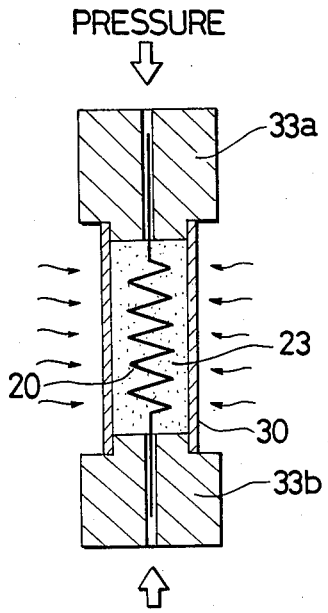
FIG. 6 is a sectional view for explaining how the heat-resistant insulating powder is filled in a holder of FIG. 5.
Figure 5:
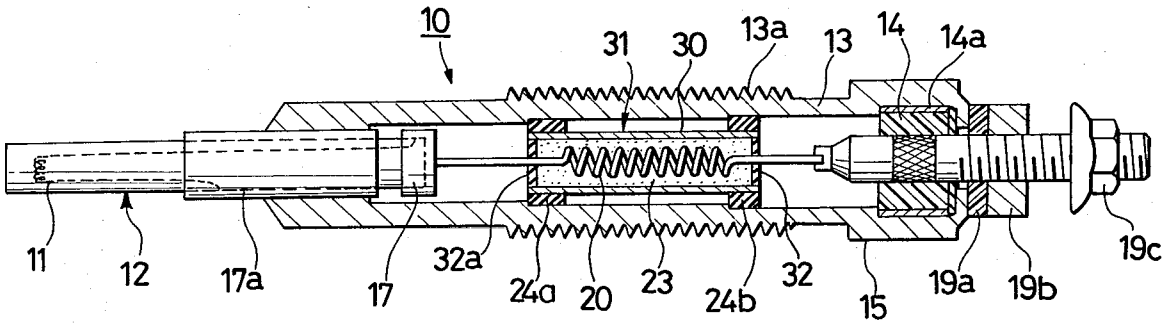
FIG. 5 is a sectional view showing another modification of the glow plug of FIG. 1.

As shown in FIG. 5, in place of the sheath heater 21, sheath heater 31 having a sheath 30 with two open ends may be used. A second resistor 20 is arranged in the sheath heater 31, and a heat-resistant insulating powder 23 is filled in the sheath 30. Furthermore, as shown in FIG. 6, after the heat-resistant insulating powder 23 is filled, the sheath 31 is vibrated and compressed from the two open ends to increase the packing density of the powder 23, thereby obtaining the same effect as described above. Reference numerals 24*a* and 24*b*, FIG. 5, respectively denote heat-resistant insulating tubes fitted to the open ends of the sheath heater 31 and loosely fitted in a holder 13. Reference numerals 32*a* and 32*b* respectively denote sealing members of ceramic cement sealed in the two open ends of the sheath 30. Reference numerals 33*a* and 33*b*, FIG. 6, respectively denote jigs for filling the heat-resistant insulating powder 23. In this case, two ends of the second resistor 20 embedded in the sheath 31 extend, and the extended ends are respectively fixed to a ceramic heater 12 and an external connecting terminal 15. However, the conections of the two ends of the second resistor are not limited to the arrangement described above.

Figure 7:
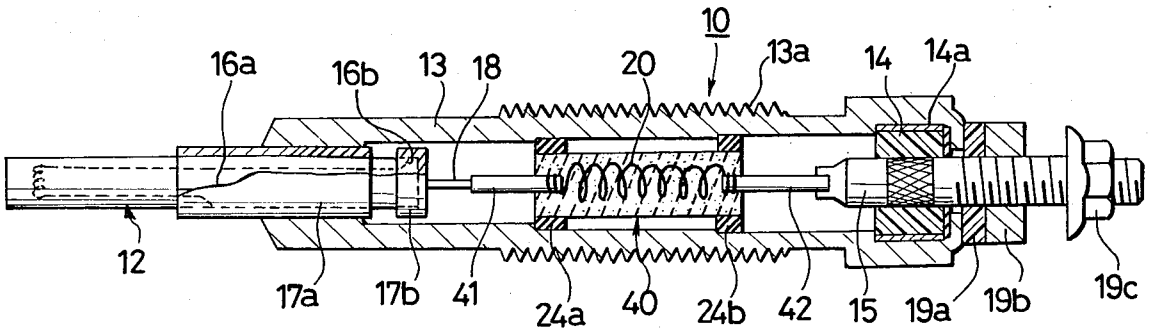
FIG. 7 is a sectional view showing still another modification of a second resistor of the glow plug of FIG. 1.

As shown in FIG. 7, instead of the sheath heaters 21 or 31, a second ceramic heater 40 having a power control second resistor 20 therein may be used. At the same time, heat-resistant insulating tubes 24*a* and 24*b* are fitted on the two end portions of the second ceramic heater 40, respectively. The resultant assembly is fitted in a holder 13.

When the second ceramic heater 40 described above is used, the second resistor 20 can be embedded in a sealed state in the ceramic powder packed with a high density to improve its heat radiation property. Heat conduction from the second resistor 20 to the outer atmosphere is stabilized, thereby stabilizing the performance of the first ceramic heater 12. The second ceramic heater 40 comprises a highly heat-resistant ceramic material of a rod-like shape and has the same insulation property as that of the ceramic heater 12. The second ceramic heater 40 has a larger heat capacity than that of the ceramic heater 12. The second resistor 20 and inner ends of lead wires 41 and 42 connected to the two ends of the second resistor 20 are embedded in the second ceramic heater 40.

The pair of heat-resistant insulating tubes 24*a* and 24*b* are fitted on the two end portions of the surface of the second ceramic heater 40, and the resultant assembly is loosely fitted in a holder 13 to form a air gap therebetween. In this manner, heat conduction from the second ceramic heater 40 to the holder 13 is properly limited. The second ceramic heater 40 has a large heat capacity so as to optimally control the temperature of the first ceramic heater 12. However, the heat-resistant insulating tube may be mounted to cover the entire surface of the second ceramic heater 40. Alternatively, the second ceramic heater 40 may be directly fitted in the holder 13.

The second ceramic heater 40 preferably comprises so-called fine ceramic (i.e., a silicon nonoxide) such as silicon nitride having good insulation and thermal impact strength properties in the same manner as in the first ceramic heater 12. The advantages of this material have been described before.

In the above embodiment, the diameters of the two insulating tubes differ from each other. However, the difference between the diameters is determined with consideration for assembly needs and the arrangement is not limited to this. Various modifications may be made in the shape of the power control second ceramic heater 40, the embedded state of the second resistor, and the electrical connections for the second resistor 20.

Figure 8A:
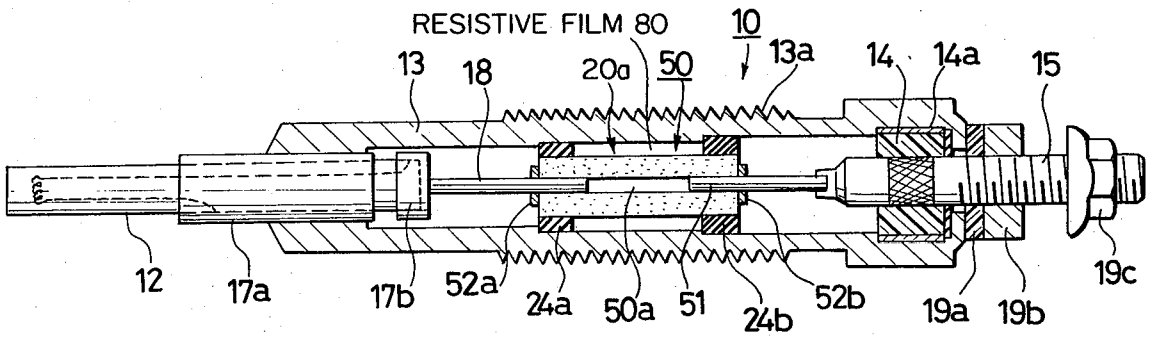
FIG. 8A is a sectional view showing still another modification of the glow plug of FIG. 1.

In place of the sheath heater 21 or 31 or the second ceramic heater 40, a film heater 50 with a resistive film as a second resistor 80 may be used as a power control heater, as shown in FIG. 8A. The overall construction of the film heater 50 will be described below. The film heater 50 comprises a cylindrical heat-resistant insulating member. Resistive films 20*a*, 20*b* and 20*c* comprising the second resistor 80 are formed on the outer surface portion and two end faces of a ceramic cylindrical member 83. Heat-resistant insulating tubes 24*a* and 24*b* are fitted on the two end portions of the outer surface of the cylindrical member 83, and the resultant assembly is fitted in a holder 13. By utilizing the film heater 50 having the arrangement described above, the second resistor 80 can be uniformly and properly arranged on the outer surface and end faces of the cylindrical member 83, thereby improving its heat radiation property, and providing the same effect as in the power control heater 21, 31 or 40.

Figure 8B:
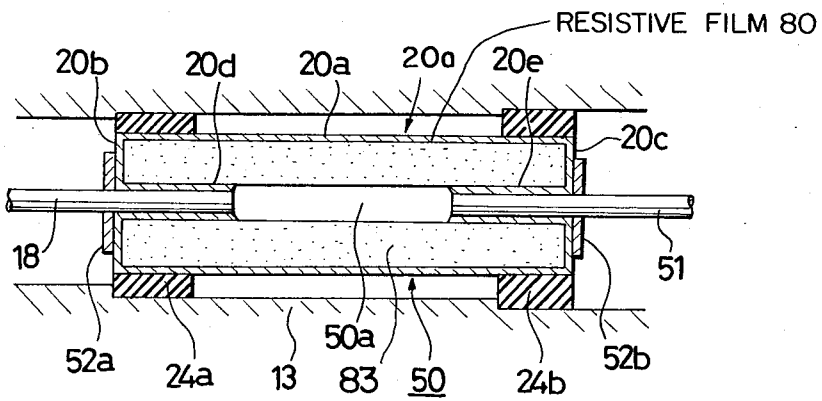
FIG. 8B is a sectional view showing the main part of the modification of FIG. 8A.

The film heater 50 will be described in more detail with reference to FIG. 8B. As described above, the film heater 50 comprises a substantially cylindrical ceramic member 83 having a good insulation property and high heat resistance in the same manner as in the ceramic heater 12. Resistive films 20*a*, 20*b*, 20*c*, 20*d* and 20*e* are formed on the outer surface and two end faces of the heater 50 and two end portions of an axial hole 50*a*, respectively. The resistive films 20*a*, 20*b*, 20*c*, 20*d* and 20*e* constitute the second resistor 80. A metal wire 18 is fitted in and brazed to one end of the axial hole 50*a* from the ceramic heater 12 (FIG. 8*a*), and a metal wire 51 is fitted in and brazed to the other end of the axial hole 50*a* from the external connection terminal 15. Reference numerals 52*a* and 52*b* respectively denote metal disks for increasing the contact areas between the metal wire 18 and the resistive film 20*b* and between the metal wire 51 and the resistive film 20*c*. In the film heater 50, an intermediate portion of the axial hole 50*a* does not have a film deposited and heater 50 employs a current path of the resistive film 20*a* on its outer surface. The material of the film heater 50 comprises a silicon nonoxide having good insulation and thermal impact strength properties in the same manner as in the ceramic heater 12. The film heater 50 generates a small amount of heat unlike in the ceramic heater 12 and does not require a high heat resistance. The ceramic material 83 can be determined from a variety of selections. In addition, the film heater 50 can be formed by reaction sintering at a low sintering temperature and can be easily manufactured. Various modifications and changes may be made in the shape of the control film heater and the electrical connections from the second resistor 80 to the outer atmosphere.

In the self temperature control type glow plug according to the present invention as described above, the rod-like ceramic heater 12 having the first resistor 11 as a heater is held at the distal end of the holder 13. At the same time, the sheath heater 21 or 31 having the second resistor 20 which is electrically connected to one end of the first resistor 11 and which is embedded and sealed by the heat-resistant insulating powder 23 filled in the metal sheath 22 or 23 is held in the holder 13 through the heat insulating tubes 24. Although the glow plug 10 has a simple structure and low cost, the second resistor 20 can be sealed and embedded in the high-density heat-resistant insulating powder 23, thereby forming the sheath heater 21 or 31. The sheath heater provides a better power control function, so that the distal end portion of the ceramic heater 12 can be optimally heated to achieve fast heating, thereby greatly improving engine starting. At the same time, a long after glow time can be achieved so as to decrease exhaust gas and engine noise. Furthermore, the overall structure is simple, and the glow plug can be easily assembled.

According to the self temperature control type diesel engine glow plug, the ceramic heater 12 has a first resistor 11 of a high-melting tungsten or platinum alloy having a ratio of a resistance at room temperature to a resistance at a high temperature of 4.5 or less. At the same time, the power control heater 21, 31, or 40 having a second resistor 20 connected in series with one end of the first resistor 11 in the ceramic heater 12 is used together with the ceramic heater. Although the overall structure is simple and inexpensive, the resistance temperature coefficient of the first resistor 11 is sufficiently smaller than that of the second resistor 20. At the same time, the control heater has the second resistor 20 sealed in a heat-resistant insulating material of a high packing density.

In particular, according to the present invention, the peak and saturation temperatures of the first resistor 11 can be decreased as compared with those of the conventional glow plug to improve durability of the plug. At the same time, the total supply current to the glow plug 10 can be deceased, and the temperature rise in the resistor portion in the holder 13 can be decreased. The glow plug according to the present invention provides high reliability against an overvoltage, and the total current consumption can be decreased.

What is claimed is:

1. A self-regulating, temperature controlled glow plug comprising:

an elongated, generally tubular hollow metal holder having two ends;

means forming a connecting terminal electrically insulated from and extending from one end of said holder;

a rod-like ceramic heater affixed to, and having a distal end extending from, the other end of said holder, and, disposed within said distal end, a first resistor with a first end conductor electrically connected to said holder and with a second end conductor extending into the interior of said holder;

a power control heater including an elongated, generally tubular sheath disposed within said holder and having an exposed central portion held in spaced apart relationship from said holder by thermal insulating spacer means disposed at at least one end of said sheath, said spacer means forming an air gap between said central portion and the interior surface of the holder, and including a second resistor having a heating capacity greater than, and having a positive resistance/temperature coefficient equal to or greater than, that of said first resistor and being disposed within the central portion of said sheath not engaged by said insulating means, said second resistor having a third end conductor electrically connected to said second end conductor, and having a fourth end conductor electrically connected to said connecting terminal, said sheath being filled with heat resistant insulating powder densely compacted around said second resistor.

whereby following energization, the distal end of said ceramic heater is caused to rapidly rise to a relatively high peak temperature and then to fall back to a lower saturation temperature as current flow through said first resistor is gradually reduced by the change in conductivity of said second resistor as its temperature is increased by heat accumulating within said holder.

2. A self-regulating, temperature controlled glow plug as recited in claim 1, wherein said first resistor is made of a high melting point metal alloy having a resistance ratio of not more than 4.5 from approximately 20 degrees C. to said peak temperature of approximately 1000 degrees C.

3. A self-regulating, temperature controlled glow plug as recited in claim 2, wherein said first resistor is made of a tungsten based alloy containing tungsten as a major constituent thereof together with at least one constituent selected from the group consisting of rhenium and molybdenum.

4. A self-regulating, temperature controlled glow plug as recited in claim 3, wherein said second resistor is made of a material selected from the group consisting of tungsten, nickel and iron.

* * * * *